United States Patent [19]

Coultas et al.

[11] 4,261,263

[45] Apr. 14, 1981

[54] RF-INSENSITIVE SQUIB

[75] Inventors: Terrence J. Coultas, Canyon Country; Jack B. Watson, Valencia, both of Calif.

[73] Assignee: Special Devices, Inc., Newhall, Calif.

[21] Appl. No.: 49,963

[22] Filed: Jun. 18, 1979

[51] Int. Cl.[3] ..... F42C 19/06

[52] U.S. Cl. ..... 102/28 R; 102/28 EB; 102/203

[58] Field of Search ..... 102/28 R, 28 EB, 28 P, 102/203

[56] References Cited

U.S. PATENT DOCUMENTS

| | | | |
|---|---|---|---|
| 3,100,447 | 8/1963 | Betts | 102/28 EB |
| 3,257,946 | 6/1966 | Tognola | 102/28 R |
| 3,524,408 | 8/1970 | Pierson | 102/28 R |
| 3,572,247 | 3/1971 | Warshall | 102/28 R |
| 3,756,154 | 9/1973 | Snyder | 102/203 |
| 3,783,787 | 1/1974 | Thornley | 102/24 R |
| 3,867,885 | 2/1975 | Gawlick et al. | 102/28 R |
| 3,971,320 | 7/1976 | Lee | 102/28 R |
| 4,061,088 | 12/1977 | Ueda | 102/28 R |

*Primary Examiner*—Peter A. Nelson

*Attorney, Agent, or Firm*—Robert Louis Finkel

[57] ABSTRACT

Novel structure within the squib provides an internal spark gap for discharge of radio-frequency as well as static electricity, and isolation of the spark gap from the pyrotechnic charge. The preferred structure is in the form of a cup mounted inside the squib case and containing the pyrotechnic material; the bottom of the cup is partly cut away to permit the igniting filament to contact the pyrotechnic material, while the remainder of the cup bottom is welded to a terminal lead. The top of the cup is flanged outward toward the inside of the case, forming an annular spark gap. This invention is particularly advantageous in a two-pin squib with an electrically floating case, but under certain circumstances is also beneficial in a single-pin or "coaxial" squib.

11 Claims, 8 Drawing Figures

RF-INSENSITIVE SQUIB

BACKGROUND OF THE INVENTION

1. Field of the Invention

Our invention is in the field of electroexplosive devices or "initiators," and has particular application in the initiators known as "squibs"—as distinguished from detonators and primers, which differ mostly in having greater explosive energy.

The present invention is directed to rendering a squib or other initiator substantially insensitive to stray radio-frequency electromagnetic fields in the ambient surrounds, and also to electrostatic charge accumulated by ambient phenomena, so that the squib reliably responds only to applied signals of the design voltage and wattage.

This invention has principal application in squibs having two connection terminals and an electrically isolated casing, but as explained below can be used to advantage under certain circumstances in a "coaxial" squib—the type in which the casing forms one electrical terminal.

2. Prior Art

Many theories have been advanced for the observed tendency of initiators, on occasion, to ignite without deliberate signal application, and in response to those theories many squib designs have resulted purportedly eliminating such spurious ignition.

Indeed inadvertent ignition seems to have been eliminated by a number of squib designs, but only by incorporation of features which are unacceptable in one or another application. In some instances accidental ignition is eliminated in a particular application or in particular types of circumstances but not in others.

Thus a considerable array of specialized squibs has been developed, in which design complexity, production cost, size, electrical and explosive characteristics, materials of construction, and reliability of firing in response to intentionally applied signals—as well as reliability of nonfiring in the absence of such intentionally applied signals—are mutually traded off to best advantage for particular applications.

The instant invention is a response to a specialized application wherein many of the most-stringent constraints of prior applications are present in combination, and so is in a sense a highly specialized squib. However, it is sufficiently easy and economical of manufacture and use to be an acceptable substitute for many initiators whose constraints are not so severe. In this sense, therefore, the present invention may be considered to constitute an advantageous "general-purpose," though not "universal," squib.

The simplest prior-art squib design, and ironically one of the most reliable designs as to RF-insensitivity, is the single-pin "coaxial" or "coax" type mentioned earlier. Such a squib consists of a generally cylindrical case having a generally coaxially mounted terminal, and a heater wire, called a "bridge" or "bridgewire," (or other heater structure) electrically connected between the terminal and case and in thermal contact with the explosive charge, be it pyrotechnic or higher-power explosive material. When used with pyrotechnic material (as opposed to primary-explosive powder) such a design is relatively insensitive to ignition by RF-induced sparks, because RF-induced voltages between pin and case are leaked off in the form of low-amperage current through the bridgewire. Much higher current levels are required to achieve the high temperatures at which pyrotechnic (metal and oxidant) formulations ignite.

There are, however, two limiting characteristics of the coax squib. First, it should not be a foregone conclusion that RF voltages always leak off across the bridge structure to the case, as this is a matter which involves the impedance of the particular bridge structure over an enormous range of RF frequencies as well as nearly unlimited variability in the orientation, polarization and power level of stray RF fields. Under just certain operating conditions it may be possible for an RF field to excite a coax-squib bridge at a frequency for which the bridge—in its squib-casing environment—is not a low impedance at all, but a very high impedance. Under these circumstances the fields may well result in an RF discharge which bypasses the bridge, igniting the explosive charge. It will be recalled that a small straight wire acts as an inductor, not a short, to radio-frequency power. It is entirely conceivable that such a wire in a particular orientation in a particular coax casing could form a tuned resonant circuit to RF power of a particular frequency, standing off the voltage and producing ignition as described above. Such phenomena may become even more likely where elaborate special geometries are employed to solve special problems in coax squibs.

For example, U.S. Pat. No. 3,867,885, assigned to Dynamit Nobel Aktiengesellschaft represents a very elaborate coax squib in which the bridge structure is metal plated or coated on an insulating disc, rather than being an initially integral wire. Thus the bridge has an exceedingly thin but relatively wide cross-section. It is disposed from a central pin or plated-through cavity radially to an annular contact ring created by the same process. At the other end of the central pin or central plated-through cavity is a circular metal disc likewise plated or coated on the bottom of the insulating disc. The insulating disc carrying the metal plated disc is placed in contact with a massive cylindrical "pole piece" which nearly surrounds the disc and plated bridge structure. A metal washer above the insulating disc makes contact with the annular contact ring previously mentioned. It would be virtually impossible to ascertain the response of this structure to all RF frequencies and field orientations which might be encountered under actual operating conditions, especially considering modifications of the thin plated-on structure which might preliminarily be caused by high-power RF fields. Thus the device is not in fact guaranteed RF-proof.

It may be noted in passing that the device of U.S. Pat. No. 3,867,885 incorporates a cup-shaped device bearing superficial similarity to a structure in a preferred embodiment of the instant invention. However, the cup-shaped device in the referenced patent is directly attached electrically to the squib casing, with no spark gap, and cannot function in the way or for the purpose described hereunder for the similar-appearing structure of the instant invention.

The second limitation of coax squibs is their susceptibility to inadvertent ignition due to an entirely different kind of accident:

Normally the case of a coax squib is placed at chassis ground of the weapon, spaceflight module, vehicle or other apparatus in which it is used, by gripping in a simple grounded receptacle. The firing signal then is applied with respect to chassis ground. The problem is that the squib can be fired by accidental touching of numerous other "hot" wires in the apparatus to the squib terminal or its signal wire, at any point in the apparatus. This can occur, for example, by a hand tool falling across two points in the circuit—or, perhaps more seriously, by a portion of the apparatus structure coming loose or sagging or being bent by unanticipated external impacts, so as to short a hot wire to the squib signal line. Just such sensitivities as this make coax squibs unacceptable in, for example, automotive air-bag inflators—where many years of use in automotive environments may readily cause just such accidents to occur.

Applications such as equipment deployment in high-reliability spaceflight vehicles, or the automotive air-bag inflator just mentioned, have given rise to the two-pin squib with floating case, in which the firing signal may be applied through an electrically isolated, floating circuit encompassing the two squib terminals. Even if the circuit is not completely "floated," a relative insensitivity to contact with the normal "hot" wires of nearby circuits can be obtained by judicious selection of voltage levels for the two signal wires to the squib.

Two-terminal, floating-case squibs may be typified by that in FIG. 1A of U.S. Pat. No. 3,783,788, assigned to Nippon Oils and Fats Company Ltd. of Tokyo. In two-terminal squibs the bridgewire, or some other igniting device, is connected between the two terminals rather than between a terminal and the case. Such devices are suggested as well by the prior-art schematic presented as FIG. 1 hereof: the case 11 has mounted within it two terminals 22 and 23, and bridgewire 21. The comments above relating to leakage across the bridgewire (from terminal to case in a coax squib) are applicable here as well (from terminal to terminal) in a two-terminal squib. That is to say, RF sparking between the terminals or pins 22 and 23 is relatively unlikely because voltage tends to be leaked off across the bridgewire—but is still possible inasmuch as the bridge structure in its squib-case environment may form a high impedance for certain RF fields, leading to a spark paralleling the bridge. In the two-terminal squib, however, there is an entirely new problem of RF arcing between either terminal 22 or 23 and the case 11, much more severe than in the coax squib, because normally there is no current leakage path to the case: by definition, the case is floating. If neither electrostatic nor radio-frequency energy is dissipated by low-current leakage, sufficient voltage of either sort can develop to cause a spark discharge within the case, as at 31 (FIG. 1), or at an externally provided safety spark gap 32, formed between one terminal 22 and an inward-extending case portion 12. To provide spatial separation within the squib case reliably capable of preventing high-voltage arcs, squibs several inches across would be required, straining both material costs and space requirements.

(While the squib case is commonly described as "floating," this terminology is intended only to mean that the case is floating with respect to the firing circuit. As to RF fields the case readily forms part of an induction loop, and as to electrostatic voltages the case in its operating environment is likely to be securely grounded or effectively at ground, or chassis ground, potential.)

U.S. Pat. No. 3,783,788 offers one ostensible solution to the electrostatic part of this problem—an electrically "leaky" insulator forming the seal between the case interior and ambient. Electrostatic charge accumulating between the pins, or between either pin and the case, dissipates by low-level current flow through the insulator. This may work quite well for reasonably gradual electrostatic accumulation, but it is not likely to offer sufficiently low impedance to prevent RF-induced sparks from terminal to case. Here again as it happens there is a superficial similarity between the internal structure "c" of the referenced patent and a part of the preferred embodiment of the instant invention. However, the structure "c" of the referenced patent is in firm electrical contact with the outer case, and is connected to neither of the two terminals; its function relates to a staging of the ignition of the various explosive charges, rather than to any spark-relief feature.

U.S. Pat. No. 4,061,088 offers another solution to the electrostatic-spark problem: ganged zener diodes between the terminals and between each terminal and the case. These diodes offer operation superior to that in the previous patent discussed, in that deliberately applied ignition signals, being below the zener threshold, are not leaked off and degraded; whereas high-voltage electrostatic charges exceed the zener threshold and are selectively dissipated. This patent represents the most recent in a sequence of progressively more specialized patents to squibs with voltage-discriminating dissipation paths, the first of which issued in 1937 as number U.S. Pat. No. 2,086,548. There are two limitations to the zener-diode approach: first, the behavior of zener diodes in response to RF induced voltages, in the confines of a squib case, is a matter for considerable conjecture or investigation; and, second, the cost of semiconductor devices of this sort may be excessive for many applications. As to the zener RF characteristic, it will be clear that if the zener diode is not fast enough to turn on and conduct sufficient electricity during a given RF half-cycle, that alone would be sufficient to negate the device's beneficial effect. More serious is the question whether the RF field "sees" the zener diode as a conductor at all, and if so whether as a resistive or reactive conductor—and if reactive, to what extent the zener might stand off RF voltage (as suggested in the case of the bridgewire, earlier), permitting a parallel spark. In short, the zener-diode-fitted squib may be totally insensitive to electrostatic interference but still quite sensitive to RF interference.

Another possibility, not described in the referenced patent but explored by the present inventors, is use of a "lossy" RF filter installed in essentially the location of the zener diodes in the previously discussed patent. It has been conclusively demonstrated that such "lossy" RF filters can provide a completely reliable leakage path for all RF induced voltages. However, as with the zener diodes, these filters are expensive; in fact, for one particular design we found that even in extremely large production quantities (e.g., millions, for automotive applications) the filters alone would cost in the neighborhood of $1.50 (1978 value). Thus the filters alone would cost roughly as much as the rest of the squib, doubling the squib cost. Such cost is generally considered unacceptable, outside of the military, spaceflight, or luxury-item fields.

Neither zener-diode and lossy-RF-filter design provides any spark-gap diversion path; both rely instead on the electronic characteristics of the respective components.

U.S. Pat. No. 3,274,937 discloses a spark gap in a two-terminal squib. However, this gap is provided for a different purpose and in a different location and fashion than the gap of the present invention, to be described hereunder. The gap of the referenced patent is in series with the ignition circuit (in this case, a bridgewire), and is intended "to make the detector immune to applied voltages below a certain critical voltage" (emphasis supplied), whereas as will be clear from the description hereunder the gap of the present invention is not in series with the ignition circuit but rather is between that circuit and the squib case, and is designed to make the squib insensitive to voltages above a threshold voltage. As a matter of fact, the referenced patent discloses no particular apparent protection against sparking between the pins and the case, especially as to the nongapped pin.

U.S. Pat. No. 3,257,946 discloses a two-pin, floating-case squib intended to display RF insensitivity, voltage and energy discrimination, and amenability to testing both without and with explosive charge in place, without firing. This device comprises a two-stage charge, with the priming charge separated from a series spark gap by a thin metal membrane. A spark in the gap, if of sufficient intensity, ruptures the membrane, thereby exposing the priming charge to the spark. The spark ignites the priming charge, which in turn ignites the main charge. Though this configuration is described as RF-insensitive, that purported characteristic is said to result from the series spark gap in one terminal pin, and the resulting voltage threshold for firing, coupled with the membrane barrier and its resulting energy threshold for firing. Thus by interference the insensitivity is to interpin RF induction, not pin-to-case induction. Consideration of the geometry suggests that the device may in fact not be at all protected against pin-to-case sparking, particularly via the ungapped pin or the membrane itself.

U.S. Pat. No. 3,971,320 shows a hybrid squib which seems to have coax and dual-pin advantages. It is a coax unit to whose metal case a second pin is electrically connected; the squib is in a plastic outer casing, with a sealed mouth penetrated by terminals. This does not give the coax's relative RF-insensitivity, with the floating case's relative immunity to accidental shorting. Unless the "mounting" which holds the squib, and other items within an inch, are dry, clean nonmetal, the squib is susceptible to arcing—from the inner metal case through plastic to whatever conductor is in striking range. The metal case, connected to one pin, can act just as do the pins in a two-pin floating-case squib, in arcing to the nearest equivalent of the floating case. Of course the reference squib is also as susceptible as any coax squib to interpin RF sparking. The most serious drawback of the reference squib is that the interior and exterior surfaces of the insulating casing 10 cannot be reliably sealed to the inner cup 12 (or the mouth seal) or the aforementioned mounting, respectively. (In many applications the squib itself forms part of a sealed system into which its ignition products are discharged.) This permits two longitudinal leakage paths to arise along the respective annular interfaces, each path passing contaminants inward and hot pyrotechnic gases outward. High-strength seals (welds, solder, compression glass, or threads) function adeuquately only with metal, noninsulating outer cases.

The foregoing discussion generally exhausts the closest related prior art of which we are aware. However, it may be useful also to consider some hypothetical geometries not known or suggested by the prior-art references, but which may be regarded as constructs produced by combining certain features of various references. In particular, single-pin coax squibs could be produced having the spark-gap and membrane of U.S. Pat. No. 3,257,946, but with the return simply connected to the case instead of a second terminal. That is, the metal membrane could be connected to the case. Such a device would of course be susceptible to accidental shorts, as is any coax squib, but it would be susceptible to membrane-to-case sparks, since the membrane would be connected to the case. The remaining question is whether it would be susceptible to sparks between the single terminal and the case. Presumably such sparks would form in the series spark gap provided for ignition sparks. If a parallel, diversion gap were defined in parallel between that terminal and the case, and if the diversion gap operated at a lower voltage than the series gap, then the device would be unfirable. If the diversion gap operated at a higher voltage than the series gap, then the diversion gap would never fire and might as well be omitted. In short, the device hypothesized is not protectable against RF overvoltage across the series spark gap. Concededly such protection might not be required, since RF-induced sparks in that gap would typically be extremely low-current sparks, incapable of rapidly piercing the membrane to gain access to the explosive charge. However, it is possible that if the squib happened to be exposed to RF fields on an essentially continuous basis, as could occur in an automotive environment (to take a circumstance in pertinent point), the low-current sparks could cumulatively degrade the membrane over a period of months or years to the point where the membrane failed. To avoid this result might require making the membrane so thick that it would not rupture rapidly enough, under application of an intentional firing signal, to provide necessary protective time response in a vehicle safety air-bag inflator or the like. In summary, a coax squib with series spark-gap and energy-discriminating membrane would have the usual susceptibility to shorting accidents of all coax squibs, and to avoid cumulative deterioration (and accidental firing) due to RF exposure might well have to have excessively slow response.

Another possibility would be to combine the "leaky" insulator of U.S. Pat. No. 3,783,788 with a coaxial geometry. The referenced patent, as may be recalled, discloses a bridgewire type of ignition means; consequently the hybrid here suggested would have the same possibility, though perhaps remote, of RF sparking in parallel with the bridgewire as any other coax squib with a bridgewire—as previously discussed. The "leaky" insulation would not be any more effective in leaking RF voltage in the coax configuration than in the two-pin configuration. And the device would of course be susceptible to accidental shorting of the single pin to a "hot" circuit element, as also previously described.

One other prior-art feature is worthy of mention, namely the provision of a spark gap between pins and case on the exterior side of a squib seal—that is to say, exposed to ambient. Such a gap is suggested at 32 in FIG. 1. Because such spark gap is so exposed, it is subject to deterioration by mechanical damage, by accumulation of dirt, or by corrosion or oxidation of the surfaces involved. While it may be unlikely that such deterioration could prevent proper bypassing of a high-voltage RF spark, it could result in similar bypassing of a deliberately applied firing signal. Consequently, exposed pin-to-case protective spark gaps are not highly regarded.

When all the constraints discussed in the preceding pages are considered in combination—constraints of response time, cost, size, reliable firing on command, and above all reliable nonfiring in the presence of (1) stray RF fields, (2) electrostatic phenomena and (3) mechanical mishaps—it becomes clear that no prior-art squib adequately satisfies the combined constraints. Just such a combination of constraints characterizes the requirements of the automotive safety devices mentioned earlier.

BRIEF SUMMARY OF THE INVENTION

It is the object of the present invention to satisfy simultaneously all of the constraints of such safety devices, including all of those mentioned in the preceding paragraph.

Our invention accomplishes that object by provision of a spark gap within the same case as the explosive charge and ignition system, in a two-terminal squib with isolated case. As previously mentioned, to provide spatial separations within the squib case reliably capable of preventing high-voltage arcs, squibs several inches across would be required, straining both material costs and space requirements. Consequently, rather than attempting to prevent the sparks they are simply diverted to a safe location within the case.

That is of course not as simple as it sounds. It is necessary to configure the internal structure of the squib carefully to provide a spark gap at a location where there is no significant possibility of explosive-charge ignition. The gap must be at least spatially separated from the explosive charge, and preferably also isolated from the charge by an interposed material barrier. Only by defining a spark gap within the controlled environment of the squib case can reliable spark characteristics be ensured, both as to reliable bypass of spurious voltages and as to reliable nonbypass of deliberately applied firing signals.

In the preferred embodiment of this invention an inner cup is mounted generally coaxially with the squib case, and spot-welded or otherwise securely connected electrically to one of the terminal pins at its interior end. The bottom of the cup is cut away to clear the interior end of the other terminal pin. A bridgewire is connected between the two terminal pins at their interior ends, effectively flush with the bottom of the cup. The top of the cup is flanged outward toward the inner cylindrical surface of the case, forming an annular spark gap; if preferred the flange may be provided with sharp points at cicumferential intervals to concentrate electrical charge and facilitate the forming of a spark. As described in detail hereunder, the cup and flange are stabilized within the case radially and axially by a solid insulating sleeve and washer respectively. The terminal pins are stabilized within the case preferably by embedment in a glass-insulated "header" structure which terminates substantially coplanarly with the interior ends of the terminal pins, so that the bridgewire is supported on the interior surface of the header, and the explosive charge in the region of the cup bottom which is cut away is likewise supported on the header surface. For greatest strength and reliability the header may be welded to the case, to minimize possibility of leakage of moisture, corrosives, or radio-frequency electromagnetic fields.

Additional protection against interterminal sparking may be provided if desired by threading ferrite beads over the two terminal pins, on the external side of the header.

The principles and features introduced above, and their advantages, may be more-fully understood from the detailed disclosure hereunder, with reference to the accompanying drawings, of which:

It may be helpful to note that FIGS. 2, 4, 5, 6 and 8 relate to a two-pin, isolated-case squib with a bridgewire used as ignition device.

Figures 1, 2, 3, 4:
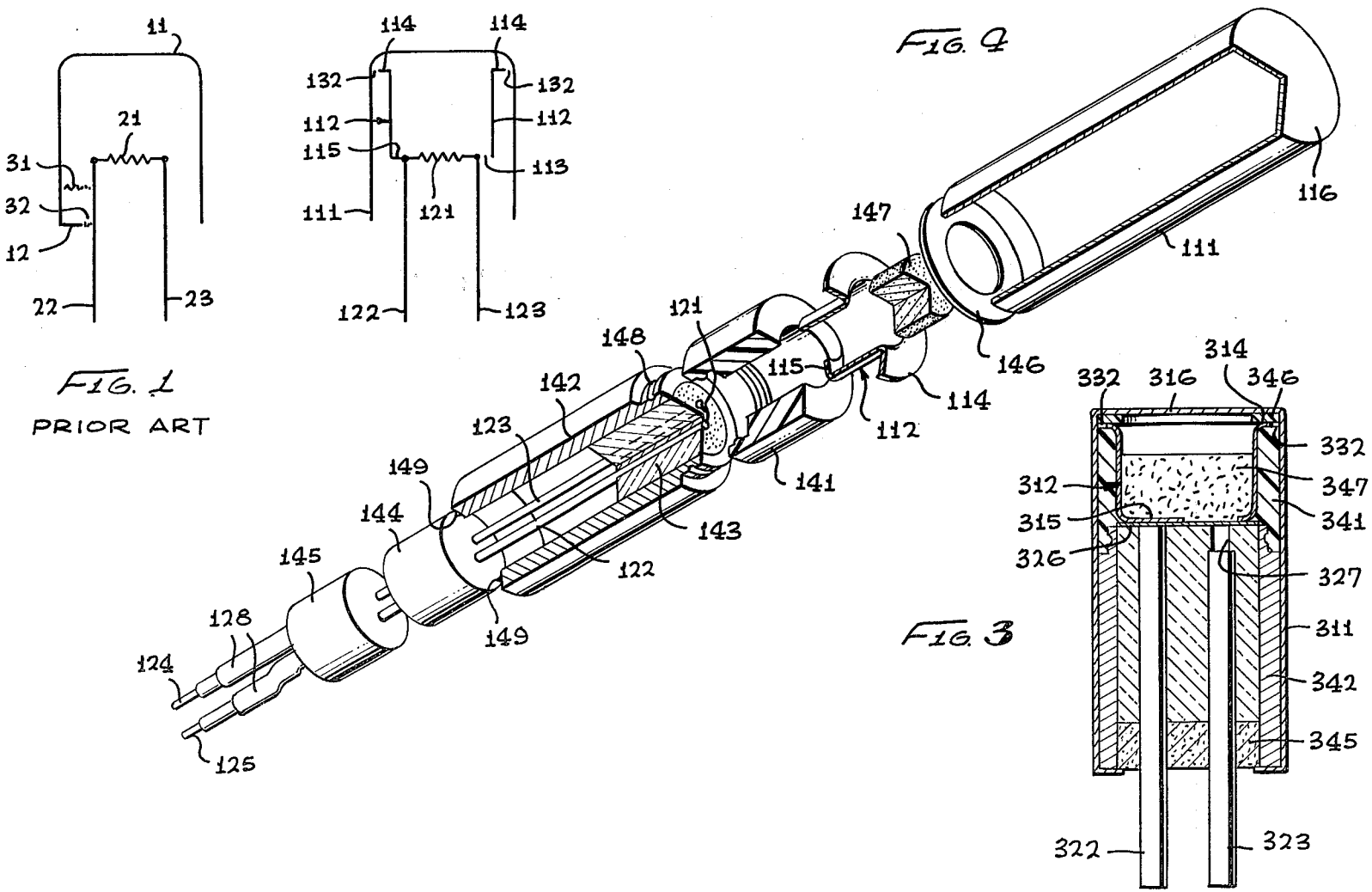
FIG. 1 PRIOR ART
FIG. 1, already discussed, is a schematic drawing representing the prior art.
FIG. 2 is a similar schematic drawing representing a preferred embodiment of the present invention.
FIG. 3 is a cross-sectional elevation of another embodiment of the present invention.
FIG. 4 is a partially exploded and partially cut away isometric view of the preferred embodiment of FIG. 2.

FIG. 3 relates to a two-pin isolated-case squib with a series spark gap and energy-discriminating membrane used as ignition device.

Figure 7:
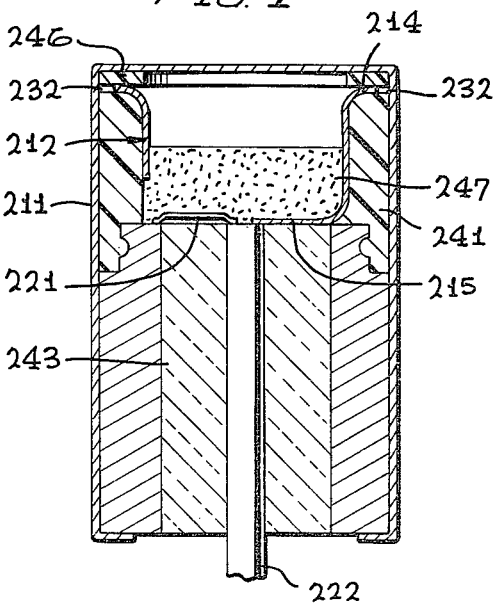
FIG. 7 is a cross-sectional elevation of another embodiment of the invention.
Figure 8:
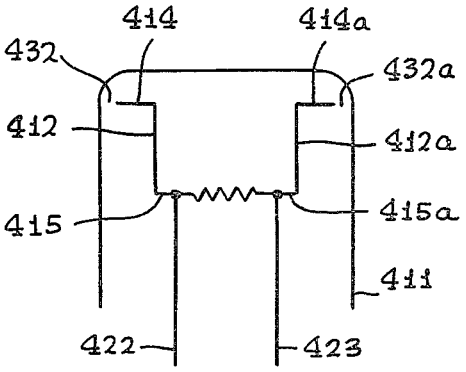
FIG. 8 is a schematic drawing of another embodiment of the invention.

FIG. 7 relates to a single-pin coax squib with bridgewire.

DESCRIPTION OF PREFERRED EMBODIMENTS

The basic principle of the present invention is shown schematically in FIG. 2. Within isolated case 111, to the prior-art terminals 122 and 123 and bridgewire 121 there is added a conductive shield 112, formed as at 115 to contact one of the terminals, 122, and electrically connected to that terminal 122; the shield furthermore is formed as at 114 to closely approach the interior of case 111 but is spaced (as at 132) therefrom. The shield 112 is also spaced away from the other terminal 123, by being cut away or formed as suggested at 113. Radio-frequency voltages appearing at terminal 122, rather than sparking to case 111 in the vicinity of bridgewire 121, are diverted by shield 112 and particularly its formed section 115 and flanged section 114 to spark gap 132.

Radio-frequency voltages appearing at terminal 123 typically are "leaked off" via bridgewire 121 to terminal 122, and thence via structure 115, 112 and 114 to gap 132 as before. However, as mentioned in the prior-art discussion of this specification, under certain circumstances pin-to-pin RF voltages and sparks may be a problem as well as pin-to-case; if this is considered significant the arrangement of FIG. 8 may be substituted. As suggested in that figure the shield may be split, so that section 412 with flange 414 forming gap 432 with the interior of case 411 is attached at 415 to terminal 422; and separate shield section **412*a* with flange 414*a* forming gap 432*a* with the interior of case 411 is attached at 415*a* to terminal 423**.

In either of these systems it is of course essential to ensure that the explosive charge (not shown in the schematic drawings) is adequately isolated from the spark gap(s). Such isolation is representatively illustrated in the remaining drawings.

Figure 5:
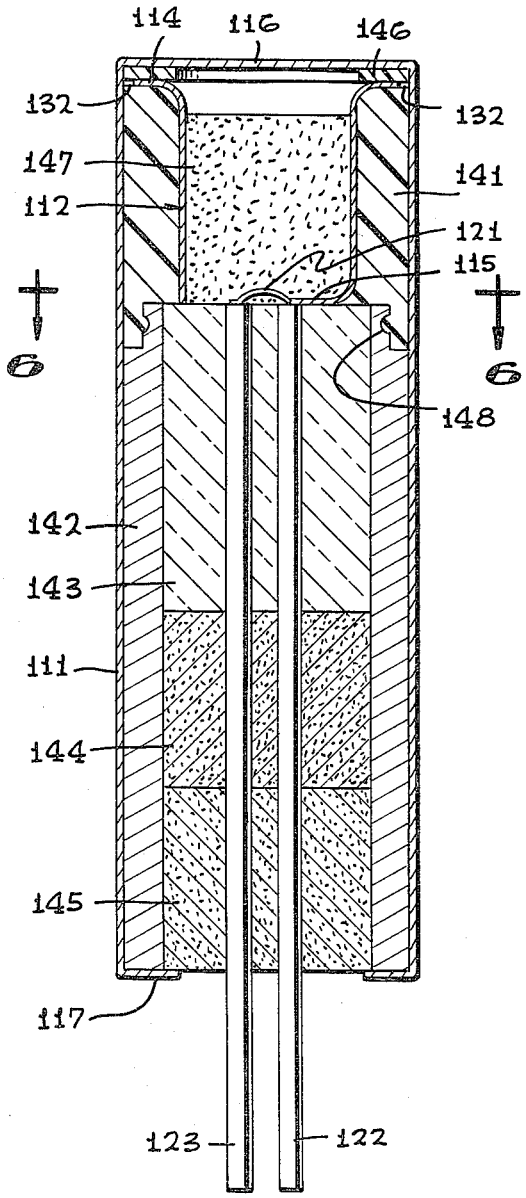
FIG. 5 is a cross-sectional elevation of the preferred embodiment of FIGS. 2 and 4.
Figure 6:
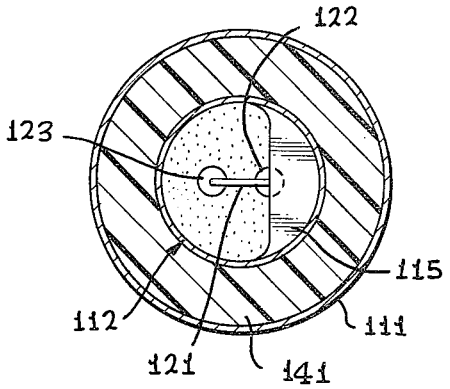
FIG. 6 is a cross-sectional plan view of the same preferred embodiment, taken along the line 6—6 of FIG. 5.

The preferred embodiment of FIG. 2 is shown in mechanical detail in FIGS. 4, 5 and 6. The same case 111, shield 112, inward-directed extension 115 and flange 114 of the shield 112, terminals 122 and 123, and spark gap 132 appear in one or more of FIGS. 4, 5 and 6—the spark gap 132 being visible particularly in FIG. 5.

The insulating washer 146 separates the flange 114 from the end wall 116 of the case 111, stabilizing the spark-gap structure axially with respect to the end wall 116. The shield 112 advantageously takes the form of a cup, with bottom 115 partly cut away to clear electrode 123, and with the open end flanged outward at 114 toward the case to form annular gap 132. The explosive charge 147, which in the instance of a squib is formed of pyrotechnic material such as metal and oxidant, rather than primary explosive material, is disposed within and compressed into the cup structure 112. In the case of other electroexplosive initiators such as primers and detonators, more-powerful explosives may be used to form explosive charge 147. The cup 112 is enclosed within insulating sleeve 141 which stabilizes the cup 112, contained charge 147, and spark-gap 132 structure radially with respect to case 111. The insulating sleeve or "charge sleeve" 141 is snap-fitted at 148 to metal header 142, which is mechanically and hermetically sealed by glass seal 143. The seal 143 in turn is penetrated by electrodes 122 and 123. The case 111 is extended longitudinally to permit inclusion within its length of two ferrite beads 144 and 145, respectively designed for function in two overlapping portions of the electromagnetic radiation frequency spectrum. The ferrite beads 144 and 145 function to short-circuit RF fields between the pins 123 and 122, thereby minimizing the likelihood of sparking between those pins. This may be regarded as an alternative to the split-shield arrangement of FIG. 8, for situations in which pin-to-pin discharge is considered a significant problem. In many situations the ferrite beads 144 and 145, as well as the split-shield arrangement, may be considered unnecessary and may be omitted.

The case 111 is crimped inward at 117 (FIG. 5) and welded to the end of the header 142. The length of the inward-extending portion 117 of the case 111 is advantageously greater than the annular radial dimension of the header 142, so that the inward extension 117 covers the interface between the header 142 and ferrite bead 145; there is otherwise some possibility of the header 142 acting as an RF waveguide for transmission of RF fields along that interface and into the region of the explosive charge.

Leadwires 124 and 125 may be soldered or attached by other suitable means to terminals 123 and 122 respectively, thereby incorporating the squib into the firing circuit. In ordinary use of course the case 111 is mounted securely in suitable disposition to a device to be ignited, or to receive the pyrotechnic combustion products for other purposes such as inflation of an automotive air bag.

As to the sequence of construction processes, it will be noted that the interior ends of the terminals 122 and 123 are substantially coplanar with the interior surface of the glass seal 143, facilitating stable positioning of the bridgewire 121 upon that interior surface while spotwelding to the terminals 122 and 123. Following that operation the charge sleeve 141 is snapped into position and the cup 112 inserted into the sleeve 141 and into contact with the said interior surface, and the inward-directed portion 115 of the cup 112 is spotwelded to the terminal 122. Next the explosive charge 147 is volumetrically loaded and tamped into compressed adhesion to the interior of the cup 112. (Excess powder is advantageously removed as by a specialized "vacuum-cleaner" device.) This entire assembly then is inserted into the case 111, preceded only by the insulating washer 146. Ferrite beads 144 and 145 are next threaded over the terminals 123 and 122 and into the shield 142. The end of the case next is crimped inward at 117 and "projection welded" to the shield 142, making use of a sharp annular projection 149 (FIG. 4) initially provided at the open end of the shield 142. After the welding step this projection 149 is substantially flattened out, and so does not appear in FIG. 5. Finally, leadwires or "pigtails" 124 and 125 are added, with transparent plastic protectors 128 permitting visual inspection to monitor quality of the solder joint or other attachment.

As shown in FIG. 3 the present invention may be used in conjunction with the spark-gap ignition system described in the previously discussed U.S. Pat. No. 3,257,946. The reference numerals in FIG. 3 parallel those of FIG. 5, except that the initial number of each is a "3" instead of a "1"; thus, for example, the end of the squib case is designated "316" in FIG. 3 rather than "116" as in FIG. 5. The various correspondingly numbered elements are in fact essentially identical, except as follows. In the system of FIG. 3 there is no bridgewire; instead a metal foil 326 is incorporated as in the referenced patent, and a spark gap 327 is provided between the terminal 323 and the foil 326. Operation is substantially the same as described in the referenced patent, but the spark gap 332 operates analogously to the gap 132 of FIG. 5 to prevent RF-induced sparking between the foil and the case via the explosive charge. For simplicity only one ferrite bead 345 has been shown, rather than two as in FIG. 5. As explained in the referenced patent, the series spark gap 327 sustains an arc only when sufficient voltage is applied across the terminals 322 and 323, thereby screening out or discriminating against spurious voltages which are too low to start an arc in the series gap 327; RF-induced arcing within the gap 327 is characteristically of inadequate current level to rupture the foil 326, but that is not true of the low-impedance source from which deliberately applied firing voltages are obtained, so the foil screens out or discriminates against spurious signals of inadequate energy content. Cumulative deterioration to the foil 326 by long-term exposure to low-power RF sparking is avoided to the extent that the "hot" or "swing" side of the induced RF voltage appears on terminal 322, from which it may be diverted via gap 332 to the case 311. Thus the gap 332 serves a dual function, tending to protect the foil 326 from deterioration by RF exposure and thus avoid long-term damage and eventual unintended firing, as well as protecting the explosive charge against direct ignition by RF voltage, i.e., immediate unintended firing.

As shown in FIG. 7 the present invention may be used in conjunction with a coaxial squib configuration, to overcome the relatively minor danger of RF-induced spark ignition in such devices. Again the reference numerals parallel those used in FIGS. 2 through 6, but in FIG. 7 a numeral "2" is used as the first digit in each rather than a numeral "1" or "3"; and in FIG. 7 there is no separate terminal analogous to 123 in FIG. 5, the bridgewire 221 being, for example, returned via header 242 to the case 211. To the extent that the bridgewire 221 may represent a high impedance to certain RF fields under particular conditions, parallel sparking to the case is prevented by diversion of the RF voltage through cup-shaped shield 212 (including its lower inward-extending section 215 and its upper flange 214) to the case 211 via annular spark gap 232.

In the various embodiments shown the washer 146, 246 or 346 serves as a physical barrier to exposure of the explosive charge to the spark at the annular gap. This physical barrier is desirable primarily in event a few grains of the explosive charge might happen to be loose near the flanged end of the cup; otherwise spatial separation of the spark gap from the main body of the explosive charge would be sufficient to isolate the spark gap from the charge, especially with the inherent spatial separation of the flange geometry. In short, the interposition of an imperforate ignition barrier is not absolutely required, and may be omitted especially in cases where the orientation of the device in use virtually guarantees that there will be no migration of the explosive charge to the region of the spark gap. The relative likelihood of such migration may be best evaluated by a designer skilled in the art of squib design, taking into account the circumstances of a particular application. Thus the provision of "means for isolating the explosive charge from the spark gap," as recited in the appended claims, may in particular appropriate circumstances be accomplished merely by suitable and adequate spatial separation of the charge from the gap.

The spark gap of the various embodiments of the present invention, while particularly directed to avoiding RF-induced sparking through the explosive charge, also serves excellently in avoiding electrostatically caused ignition, without the necessity or uncertainty of "leaky" resistors or expensive semiconductor devices.

Our tests on prototype squibs show that the RF protection afforded by the present invention is not as great as that of "lossy" RF filters, but is completely adequate for many very demanding applications, including the automotive application mentioned earlier, and at a much lower cost. In a typical unit the RF power required for ignition by a pin-to-case spark was below 500 milliwatts without the diverting shield and spark gap, and was well over 10 watts with that structure. Interestingly, even pin-to-pin firing seemed to be favorably affected, and by a factor between 4 and 10.

It will be understood that the foregoing disclosure is exemplary only, and not to be construed as limiting the scope of our invention, which scope is to be ascertained only by reference to the appended claims.

We claim:

1. An electroexplosive initiator configured to divert electrostatic and radio-frequency sparks to an internal noninitiating spark gap, said initiator comprising:

an electrically conductive case;

an explosive charge within the case;

a seal for sealing at least part of the interior of the case against the ambient surrounds, the explosive charge being in the sealed part;

at least one electrical terminal penetrating the seal;

means, disposed within the case on the interior side of the seal and in functional relation with the interior end of the terminal, and responsive to application of an electrical signal to the ambient-exposed end of the terminal, for igniting the charge;

means, electrically connected to the interior end of the terminal, defining a first electrode within the case;

means, electrically connected to the interior of the case, defining a second electrode which is within the case and juxtaposed to the first electrode and defines therewith a spark gap; and means for isolating the explosive charge from the spark gap.

2. The initiator of claim 1, wherein:

the first electrode means comprise an electrically conductive shield surrounding the explosive charge and mounted within but electrically insulated from the case; and the isolating means comprise structure spatially separating the explosive charge from the gap.

3. The initator of claim 2, wherein the second electrode means comprise a portion of the interior surface of the case.

4. The initiator of claim 2 wherein:

a portion of the shield is angled away from the explosive charge and toward the second electrode.

5. The initiator of claim 2 wherein the isolating means also comprise an ignition barrier interposed between the spark gap an the explosive charge.

6. The initiator of claim 1 wherein the igniting means comprise:

a second terminal penetrating the seal; and a conductive filament connected between the interior ends of the terminals and in thermal contact with the explosive charge.

7. The initiator of claim 1 wherein the igniting means comprise a conductive filament connected between the interior end of the terminal and the interior of the case, and in thermal contact with the explosive charge.

8. The initiator of claim 1 wherein the igniting means comprise a second terminal penetrating the seal, and a second spark gap defined between the interior ends of the terminals and juxtaposed to the explosive charge so that a spark in the second gap ignites the explosive charge.

9. The initiator of claim 8 wherein:

a metal membrane is attached to the second terminal, forming an extension thereof;

the second spark gap is defined between the metal membrane and the said one terminal; and the metal membrane is interposed between the explosive charge and the second spark gap, so that only sparks of sufficient energy content in the second gap perforate the membrane and ignite the explosive charge.

10. An electrically actuated explosive firing device adapted to resist accidental ignition by high radio-frequency electromotive induction or electrostatic discharge, comprising:

an electrically conductive casing;

an electrically conductive receptacle mounted within and spaced from the casing and forming a spark gap therewith;

an explosive charge disposed within the receptacle;

a first electrical terminal pin fixed with respect to the casing, and connected to and in electrical contact with the receptacle;

a second electrical terminal pin fixed with respect to the casing and electrically isolated from the receptacle; and a bridgewire in electrical contact with said first and second pins for igniting the explosive charge.

11. The device of claim 10, also comprising at least one ferrite bead positioned for penetration by at least one of the terminal pins.

* * * * *